US010536232B2

(12) United States Patent
Whikehart et al.

(10) Patent No.: US 10,536,232 B2
(45) Date of Patent: Jan. 14, 2020

(54) INTEGRATING AUDIO CONTENT WITH ADDITIONAL DIGITAL CONTENT

(71) Applicants: J. William Whikehart, Milford, MI (US); Shadi Mere, Ann Arbor, MI (US); Theodore Charles Wingrove, Plymouth, MI (US)

(72) Inventors: J. William Whikehart, Milford, MI (US); Shadi Mere, Ann Arbor, MI (US); Theodore Charles Wingrove, Plymouth, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 271 days.

(21) Appl. No.: 14/753,921

(22) Filed: Jun. 29, 2015

(65) Prior Publication Data

US 2016/0380713 A1 Dec. 29, 2016

(51) Int. Cl.

| | |
|---|---|
| ***H04H 60/88*** | (2008.01) |
| ***H04H 60/43*** | (2008.01) |
| ***H04H 60/64*** | (2008.01) |
| ***H04H 20/24*** | (2008.01) |
| ***H04H 60/27*** | (2008.01) |

(52) U.S. Cl.

CPC ..... *H04H 60/88* (2013.01)

(58) Field of Classification Search

CPC ..... H04H 60/88; H04H 60/43; H04H 60/64; H04H 20/24; H04H 60/27

USPC ..... 709/219

See application file for complete search history.

(56) References Cited

U.S. PATENT DOCUMENTS

| | | | | |
|---|---|---|---|---|
| 6,349,329 | B1 * | 2/2002 | Mackintosh | G06Q 30/02 709/217 |
| 6,442,598 | B1 | 8/2002 | Wright et al. | |
| 6,559,773 | B1 * | 5/2003 | Berry | B60K 35/00 340/531 |
| 7,599,689 | B2 * | 10/2009 | Makipaa | G06Q 30/02 455/186.1 |
| 7,711,838 | B1 * | 5/2010 | Boulter | G06F 17/30761 709/231 |

(Continued)

FOREIGN PATENT DOCUMENTS

| | | | |
|---|---|---|---|
| CN | 102439882 | A | 5/2012 |
| JP | 2004-040697 | A | 2/2004 |

(Continued)

OTHER PUBLICATIONS

Chinese Office Action for Chinese Application No. 201610495875.2 dated Mar. 11, 2019, 8 pages.

*Primary Examiner* — Sargon N Nano
*Assistant Examiner* — Chong G Kim
(74) *Attorney, Agent, or Firm* — Dickinson Wright PLLC

(57) ABSTRACT

Systems and methods for integrating audio content presented via an audio playback device with additional digital content are provided herein. The system includes a content retriever configured to retrieve the audio content from a terrestrial radio station, and retrieve the additional digital content from an Internet streaming channel, the terrestrial radio station and the Internet streaming channel being associated with an audio program; and being configured to output the additional digital content. Further included herein is a method for delaying a delivery of additional audio content.

17 Claims, 5 Drawing Sheets

(56) References Cited

U.S. PATENT DOCUMENTS 7,970,379 B2 * 6/2011 White ..... G06Q 30/0267 455/3.01
8,792,850 B2 * 7/2014 Qureshey ..... G06F 17/30749 455/3.02
2002/0018874 A1 2/2002 Nakamura et al.
2002/0073171 A1 * 6/2002 McDowall ..... H04H 20/77 709/217
2002/0073179 A1 * 6/2002 Mackintosh ..... H04H 20/02 709/219
2002/0188746 A1 * 12/2002 Drosset ..... H04H 20/02 709/231
2006/0293964 A1 12/2006 Akihata
2007/0014536 A1 * 1/2007 Hellman ..... G11B 27/034 386/259
2009/0029051 A1 1/2009 Fitzpatrick et al.
2009/0030537 A1 * 1/2009 Hartle ..... H04H 60/63 700/94
2009/0264149 A1 * 10/2009 Miller ..... H04H 60/13 455/552.1
2009/0275306 A1 * 11/2009 Kraft ..... H04H 60/74 455/344
2009/0290519 A1 * 11/2009 Griffin, Jr. ..... H04B 1/086 370/310
2010/0076576 A1 * 3/2010 Lee ..... H04L 65/4076 700/94
2010/0081404 A1 * 4/2010 Harrison ..... H04H 60/74 455/186.1
2010/0267331 A1 * 10/2010 Ingrassia ..... H04H 20/26 455/3.04
2010/0268360 A1 * 10/2010 Ingrassia ..... G06F 17/30749 700/94
2011/0124283 A1 * 5/2011 DeLuca ..... H04H 20/62 455/3.06
2011/0185278 A1 * 7/2011 Flickinger ..... H04H 60/46 715/727
2012/0040605 A1 * 2/2012 Morton ..... H04H 20/24 455/3.06
2012/0040652 A1 * 2/2012 Lewis ..... H04M 3/4938 455/414.2
2012/0221188 A1 * 8/2012 Kelly, III ..... G06F 1/1626 701/29.1
2012/0268294 A1 * 10/2012 Michaelis ..... G06F 9/4443 340/905
2012/0290738 A1 * 11/2012 Lau ..... H04L 29/06448 709/231
2013/0117299 A1 * 5/2013 Kraatz ..... H04H 60/74 707/769
2013/0190948 A1 * 7/2013 Baddoo ..... B64D 11/0015 701/3
2013/0200991 A1 8/2013 Ricci et al.
2014/0018006 A1 * 1/2014 Petrucci ..... H04H 60/51 455/66.1
2014/0136330 A1 * 5/2014 Smereka ..... G06Q 30/0265 705/14.62
2014/0164579 A1 * 6/2014 Douthitt ..... G07C 5/008 709/219
2014/0225724 A1 * 8/2014 Rankin ..... G06F 3/048 340/438
2014/0236730 A1 * 8/2014 White ..... G06Q 30/0267 705/14.64
2014/0335834 A1 * 11/2014 Emerson, III .... G06F 17/30743 455/414.1
2015/0032800 A1 * 1/2015 Hrabak ..... B60R 16/0231 709/203
2015/0043745 A1 * 2/2015 Juzswik ..... H04B 1/00 381/86
2015/0056917 A1 * 2/2015 Lee ..... H04H 60/37 455/3.06
2015/0098584 A1 * 4/2015 Emani ..... H04R 3/00 381/81
2015/0124971 A1 * 5/2015 Haslam ..... H04H 20/20 381/2
2015/0193516 A1 * 7/2015 Harb ..... G06F 16/60 707/625
2015/0227304 A1 * 8/2015 Craig ..... G06F 3/04847 715/833

FOREIGN PATENT DOCUMENTS

JP 2004088366 A 3/2004
JP 2004213570 A 7/2004
JP 2005151434 A 6/2005
JP 2005-331680 A 12/2005
JP 2009-10973 A 1/2009
JP 2010-109926 A 5/2010
JP 2011-077718 A 4/2011
WO 00/46944 A2 8/2000
WO 2005/089476 A2 9/2005
WO 2008/071460 A1 6/2008

* cited by examiner

INTEGRATING AUDIO CONTENT WITH ADDITIONAL DIGITAL CONTENT

BACKGROUND

Traditionally, radio has been provided via a transmitter propagating radio waves at various frequencies, and a receiver being configured to receive the radio waves ("terrestrial radio"). This information has traditionally been provided mostly as audio. In recent times, the audio information has been augmented with other information, such as text.

The standard implementation of a radio involves a terrestrial broadcast of information from a source antenna. The radio may be configured with a receiving antenna, and tuned to receive a specific frequency. The frequency being tuned to may pick up waves being propagated in the air that are strong enough to be converted into audio information.

Radios may be carried or implemented in a whole host of situations. For example, a person may carry a portable radio with them, and listen to the radio via a speaker or head phones. Often times, radios are implemented in a motor vehicle, such as in or around a centerstack area.

In recent times, different methods have been employed to transmit audio or other information. One such popular implementation is an Internet streaming channel. An Internet streaming channel is a specific web site or application connected site, capable of delivering audio information to an Internet capable device. The user of the Internet capable device may enter in a specific channel, or access the channel through a recommendation service or graphical user interface (GUI).

The Internet streaming channel transmits packets of data via an established Internet connection. The Internet connection may be any sort of wide area network (WAN) facilitated by communication protocols that allow the transmitting and receiving of digital data. The Internet connection may be facilitated by a wireless communication with a satellite, or a connection over an established medium for communication such as a fiber optic line or telephonic connection.

Vehicles are being implemented with Internet connections. Thus, audio head units, such as those commonly found in a centerstack location of the vehicle, are provided with the ability to access data via an Internet streaming channel.

Often times, the context associated with a terrestrial radio station may also be provided via a channel devoted for Internet streaming. Thus, a consumer of an audio program may choose between the radio broadcast and the Internet streaming channel.

Certain receivers of Internet streaming channels may also be equipped with a digital display or secondary output device. Often times this is a screen capable of providing digital information transmitted along with the audio content transmitted from the Internet streaming channel. The additional digital information may be transformed into user engage-able content, for example, content displayed on a human machine interface (HMI). Thus, the additional content may be clickable, accessible, or the like, and once engaged, may allow the user to access additional information. The additional information may be text providing information about the audio content being streamed, or a link to a sponsorship or commercial application associated with the audio information. Alternatively, the additional information may be a picture or video provided to augment the audio content.

SUMMARY

The following description relates to system and methods for integrating audio content with additional digital content (in real-time or stored). Exemplary embodiments may also be directed to any of the system, the method, an application provided on a personal device associated with the aspects disclosed herein.

Additional features of the invention will be set forth in the description which follows, and in part will be apparent from the description, or may be learned by practice of the invention.

A system and method for integrating audio content presented via an audio playback device with additional digital content is provided herein. The system includes a content retriever configured to retrieve the audio content from a terrestrial radio station, and retrieve the additional digital content from an Internet streaming channel, the terrestrial radio station and the Internet streaming channel being associated with an audio program; and a display driver configured to communicate the additional digital content to an human-machine interface (HMI) display along with the presentation of the audio content.

It is to be understood that both the foregoing general description and the following detailed description are exemplary and explanatory and are intended to provide further explanation of the invention as claimed. Other features and aspects will be apparent from the following detailed description, the drawings, and the claims.

DESCRIPTION OF THE DRAWINGS

The detailed description refers to the following drawings, in which like numerals refer to like items, and in which.

DETAILED DESCRIPTION

Figure 1:
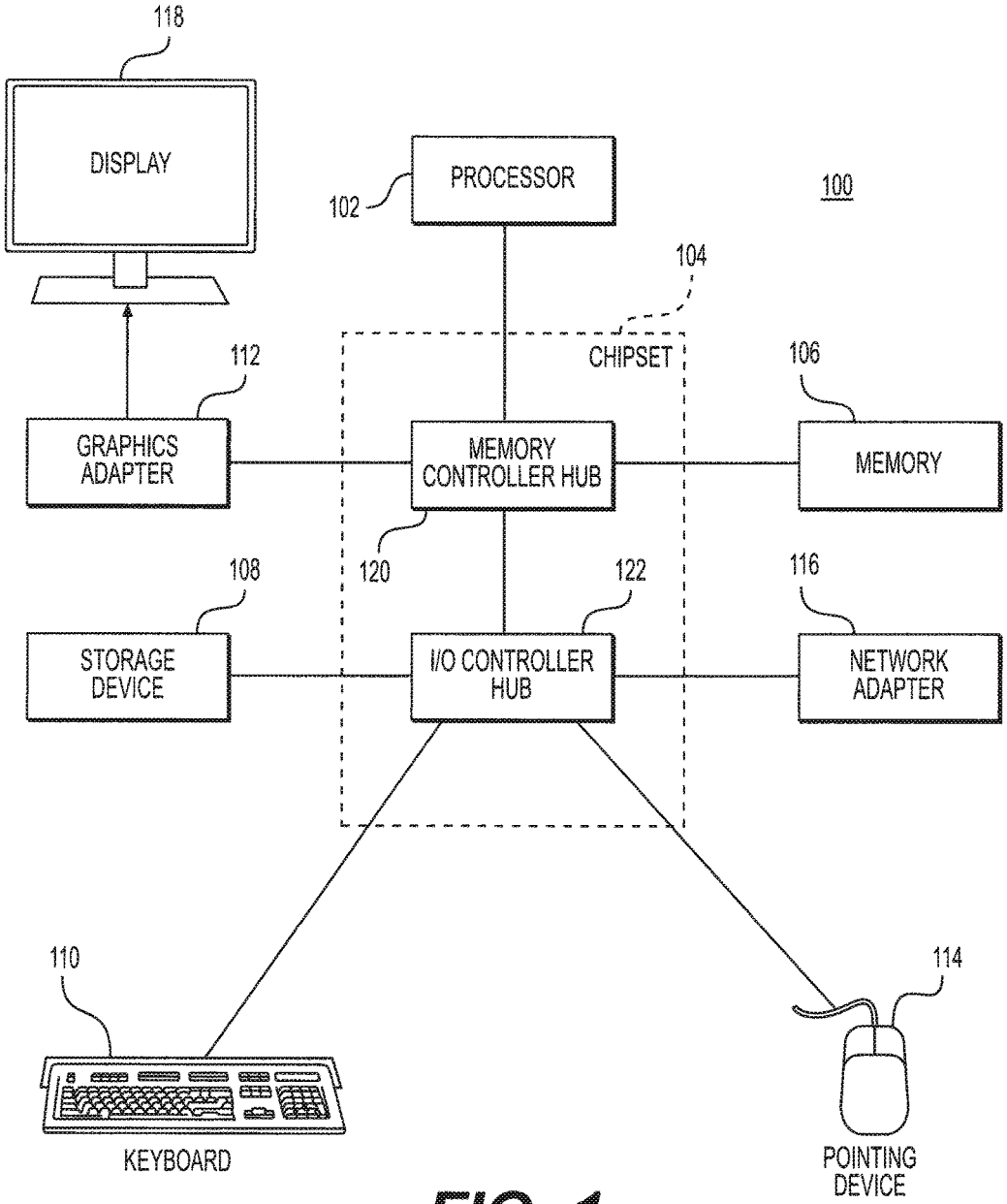
FIG. 1 is a block diagram illustrating an example computer.

The invention is described more fully hereinafter with references to the accompanying drawings, in which exemplary embodiments of the invention are shown. This invention may, however, be embodied in many different forms and should not be construed as limited to the embodiments set forth herein. Rather, these exemplary embodiments are provided so that this disclosure is thorough, and will fully convey the scope of the invention to those skilled in the art. It will be understood that for the purposes of this disclosure, "at least one of each" will be interpreted to mean any combination the enumerated elements following the respective language, including combination of multiples of the enumerated elements. For example, "at least one of X, Y, and Z" will be construed to mean X only, Y only, Z only, or any combination of two or more items X, Y, and Z (e.g. XYZ, XZ, YZ, X). Throughout the drawings and the detailed description, unless otherwise described, the same drawing reference numerals are understood to refer to the same elements, features, and structures. The relative size and depiction of these elements may be exaggerated for clarity, illustration, and convenience.

Electronic devices, such as conventional radios, are configured to receive radio broadcasts. As explained in the Background, a radio broadcast is received via a terrestrial transmitter, with the waves resonating with an antenna, and being filtered and received with a tuning system. Radio waves have been broadcast in this manner for decades, and as explained above, have been implemented various contexts, such as home entertainment systems and vehicles.

Increasingly, audio content is being provided in another manner, an Internet streaming channel. The Internet streaming channel may be accessed via a web portal, an application, or the like. The Internet streaming channel in response to a manual request or an automatic algorithm, selects audio content to be transmitted to the receiver via an Internet connection.

The audio content may be provided with augmented content (for example visual, non-visual, audio, text, multimedia, metadata and the like). The augmented content may be digital data transmitted via an Internet connection. Thus, a receiver may be capable of displaying additional photos, text, metadata, video, or combinations thereof along with the presented audio content. Augmented content may be, but is not limited to, graphics elements (static, sequenced or animated), video clips, text (displayed as text for reading, or output as audio using TTS), audio content intended to be stored and accessible later (e.g. stored in a common compressed form), and types of data content that might be useful within the system (e.g. a suggested playlist).

Increasingly, stations that were traditionally associated with one form of transmission (a terrestrial broadcast or the Internet) are being provided on both mediums. Thus, a user or operator may have a device capable of receiving both forms of audio.

In certain cases, the device may be equipped with a system or technique for selecting a more receivable signal. By being more receivable, the signal is received in a manner that allows for more playback clarity. Thus, if the radio broadcast is more receivable, the device may be configured to provide a radio transmission. In another example, if the Internet streamed channel is stronger, the device may be configured to provide and receive data associated with the Internet streaming channel.

Certain technologies have been proposed that facilitate the switching between both sources. In these cases, the technologies automatically switch based on a detected signal, a user preference, or another technique.

However, in response to a user engaging with the system in the manner above, if the listener of the audio content is being provided a radio broadcast, the listener may be missing other information, such as augmented content associated with an Internet streaming channel.

Disclosed herein are methods and systems of seamlessly integrating radio content with augmented content. The systems and methods disclosed herein pertain to not only the devices receiving the content, but also to the content providers. Thus, employing the aspects disclosed herein, the listener may listen to a terrestrially provided radio broadcast and still receive augmented content provided along with a similar Internet streaming channel. In one example, the system and methods disclosed herein allow the user to have access to augmented content even when the Internet stream is hard to receive (i.e. due to a poor network connection). In another example, the systems and methods disclosed herein allow a user to turn-off reception of an Internet stream, while still having access to the augmented content (previously downloaded) associated with the Internet stream.

One advantage is that a user may use previously-received augmented content from the Internet when the Internet connection is lost (and the user is still capable of receiving content from the radio broadcast).

Another concept disclosed herein is the caching and storing of audio content based on the aspects disclosed herein. Essentially, the devices provided may be modified in a manner to allow a listener engaging to terrestrial radio content to engage in the content in a manner capable of engaging with Internet streamed provided content. Thus, if an operator is listening to the terrestrial radio content, and pauses, rewinds, fast forwards, or seeks a different location, the device disclosed herein may access the Internet streamed content (which is capable of providing content as such), and fulfill the operators request.

FIG. 1 is a block diagram illustrating an example computer 100. The computer 100 includes at least one processor 102 coupled to a chipset 104. The chipset 104 includes a memory controller hub 120 and an input/output (I/O) controller hub 122. A memory 106 and a graphics adapter 112 are coupled to the memory controller hub 120, and a display 118 is coupled to the graphics adapter 112. A storage device 108, keyboard 110, pointing device 114, and network adapter 116 are coupled to the I/O controller hub 122. Other embodiments of the computer 100 may have different architectures.

The storage device 108 is a non-transitory computer-readable storage medium such as a hard drive, compact disk read-only memory (CD-ROM), DVD, or a solid-state memory device. The memory 106 holds instructions and data used by the processor 102. The pointing device 114 is a mouse, track ball, or other type of pointing device, and is used in combination with the keyboard 110 to input data into the computer 100. The pointing device 114 may also be a gaming system controller, or any type of device used to control the gaming system. For example, the pointing device 114 may be connected to a video or image capturing device that employs biometric scanning to detect a specific user. The specific user may employ motion or gestures to command the point device 114 to control various aspects of the computer 100.

The graphics adapter 112 displays images and other information on the display 118. The network adapter 116 couples the computer system 100 to one or more computer networks.

The computer 100 is adapted to execute computer program modules for providing functionality described herein. As used herein, the term "module" refers to computer program logic used to provide the specified functionality. Thus, a module can be implemented in hardware, firmware, and/or software. In one embodiment, program modules are stored on the storage device 108, loaded into the memory 106, and executed by the processor 102.

The types of computers used by the entities and processes disclosed herein can vary depending upon the embodiment and the processing power required by the entity. The computer 100 may be a mobile device, tablet, smartphone or any sort of computing element with the above-listed elements. For example, a data storage device, such as a hard disk, solid state memory or storage device, might be stored in a distributed database system comprising multiple blade servers working together to provide the functionality described herein. The computers can lack some of the components described above, such as keyboards 110, graphics adapters 112, and displays 118.

The computer 100 may act as a server (not shown) for the content sharing service disclosed herein. The computer 100 may be clustered with other computer 100 devices to create the server. The various computer 100 devices that constitute the server may communicate with each other over a network.

Figure 2:
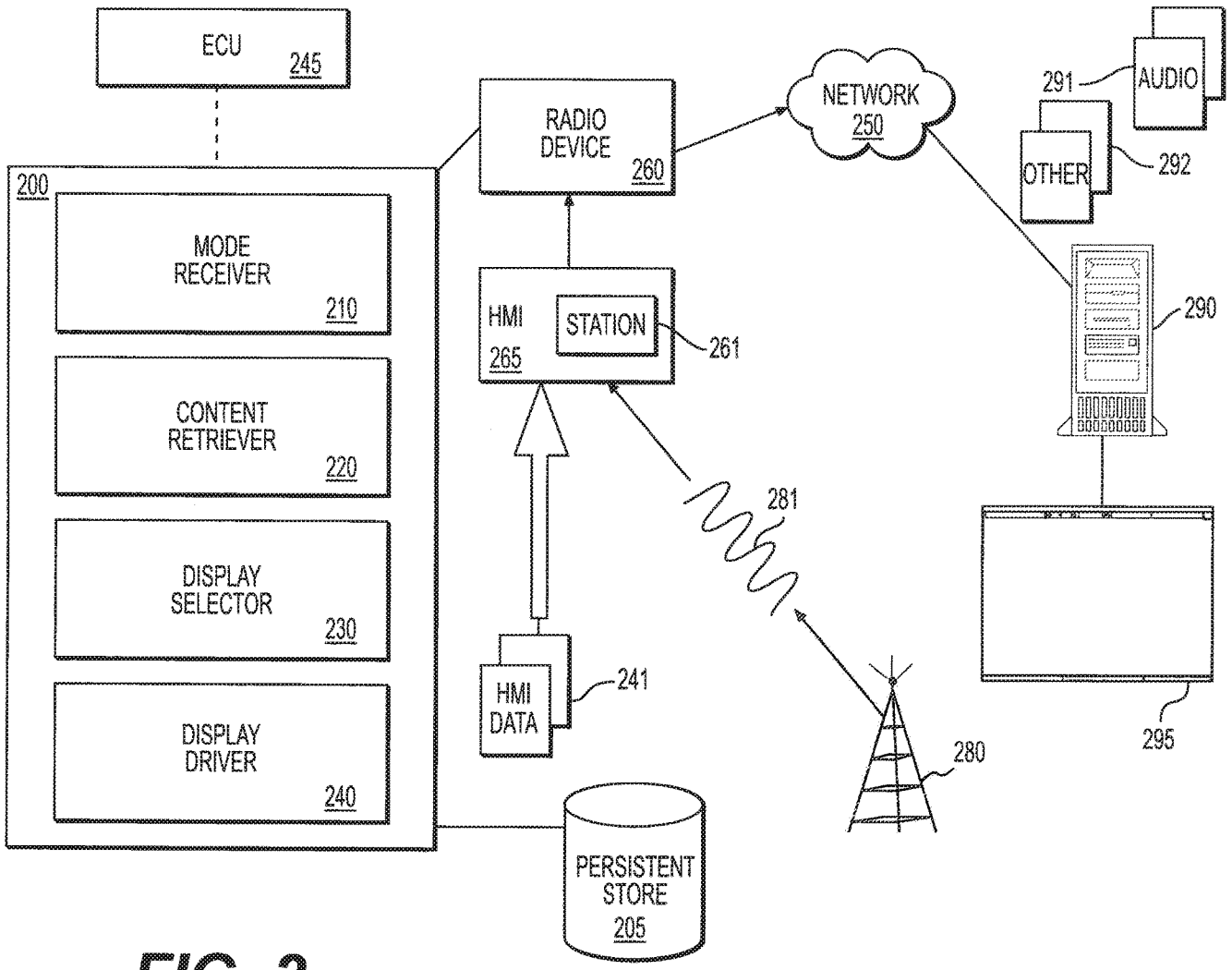
FIG. 2 illustrates an example implementation of a system for seamlessly integrating additional content with a radio broadcast.

FIG. 2 illustrates an example implementation of a system 200 for seamlessly integrating additional content with a radio broadcast. The system 200 may be implemented on a computer 100. The system 200 includes a mode receiver 210, a content retriever 220, a display selector 230, and a display driver 240.

As shown above, a radio device 260 is configured to receive a station 261 from a variety of sources. For example, the station 261 may be generated from radio tower 280, via broadcast signal 281. Alternatively, the station 261 may be generated from the Internet streaming channel 295 (hosted on server 290), via data packets 291 and 292. Data packet 291 refers to audio information associated with the Internet streaming channel 295. Data packet 292 refers to augmented content associated with the same Internet streaming channel 295.

The radio device 260 may be configured with a system to determine whether a tuned station 261 has a terrestrial radio station, Internet streaming channel, or both. Selecting between either playing the terrestrial radio station and Internet streaming channel is known, and thus, an explanation of how the radio device 260 chooses between both is omitted.

The mode receiver 210 is configured to receive a specific mode the radio device is in. In certain cases, the radio device 260 may be in the radio reception mode (i.e. receiving station information 261 via radio waves 281). In another case, the radio device 260 may be configured to receive audio information from the Internet streaming channel 295 (station 261 via audio data packet 291). The mode receiver 210 may temporarily store the present mode in a register or persistent store 205 (which may be any of the enumerated storage devices listed above, such as storage device 108).

The content retriever 220 is configured to retrieve content, such as data packet 292 regardless of whether the radio device 260 is in a radio reception mode or an Internet streaming reception mode. As explained, data packet 292 relates to content associated with data packet 291 (audio information sourced from an Internet streaming channel 295). The content may be any sort of content provided to augment the content associated with data packet 291, such as audio content, non-audio content, metadata, text, videos, or the like. Thus, the content retriever 220 retrieves this content if available whether the radio device 260 is presenting audio content from either the radio tower 270 or the Internet streaming channel 295.

The display selector 230 is configured to select whether the HMI display 265 (provided or integrated with the radio device 260) is to display the contents associated with data packet 292. If so, the display driver 240 transmits display information 241 (which is display data rendered from the received contents associated with data packet 292). In another example, the augment content associated with data packet 292 may be non-visual. Thus, the presentation may be in another format not supported by the HMI display 265, such as a secondary device (i.e. a smart phone or tablet), a speaker, or the like.

Also shown in FIG. 2 is an electronic control unit (ECU) 245. The ECU 245 may generate a signal from an external electronic control circuit, for example, those that are commonly installed in a vehicle. The decision to display the display information 241 may be delayed in response to the receipt of a specific control signal from the ECU 245. One such example is a signal indicating that a vehicle is in a non-driving state (or parked).

Figure 3:
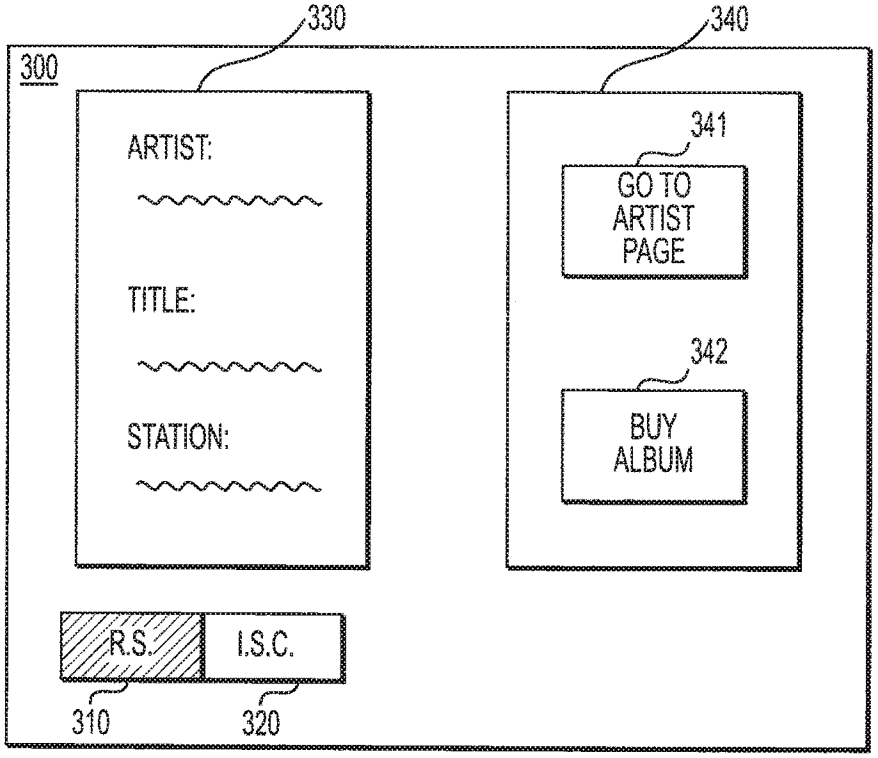
FIG. 3 illustrates an example display associated with the system in FIG. 2.

As shown in FIG. 3, an example HMI display 265 is shown with screen 300 being displayed. Screen 300 is an exemplary representation of an HMI display 265 that may accompany or be integrated with a radio device 260. The various elements 310, 320, 330, and 340 are graphical user interface (GUI) elements commonly situated with the HMI display 265.

As shown in screen 300, a user is presented an option of engaging GUI 310 (Radio station) or GUI 320 (Internet streaming channel). As shown in FIG. 3, GUI 310 is highlighted, thus indicating the user has engaged this option. The HMI display 265 may present both GUI 310 and 320 when a station has a corresponding terrestrial radio station with an Internet streaming channel. Alternatively, the user may have the option of engaging either GUI 310 or 320, and if the current mode is opposite of the indicated current mode, the mode would switch.

In GUI 330, various information about the radio station and the artist information is presented. In some cases, this information, such as basic text associated with the radio station and the received content from the radio station may be received via the content received from the terrestrially broadcast via the radio tower 280. Alternatively, the information via the GUI 330 may be sourced from an Internet connection, such as the information received via data packet 292. As explained in FIG. 2, the system 200 allows the radio device 260 to receive information via the Internet streaming channel even when a user is actively engaged and listening to a broadcast from a terrestrial source.

GUI 340 includes various information and digital display representations of information acquired from a data packet 292 (such as that generated from system 200). Thus, the display may receive display information 241 (either from the radio device 260, or directly from system 200), and transform the display information 241 into the GUI 340 as shown in FIG. 3.

In FIG. 3, various examples of GUI 340 are shown, and provide examples of augmented information that could be provided along with a received terrestrially radio broadcast. The information shown in GUI 340 is sourced from an Internet connection, and not a radio broadcast. However, employing the concepts discussed above, the data packet 292 may be matched or related with a corresponding radio broadcast, and accordingly, correspond the station being listened to.

The GUI element 341 and 342, are merely examples of GUI elements that may be provided with the system 300 and HMI display 265 shown above.

Figure 4:
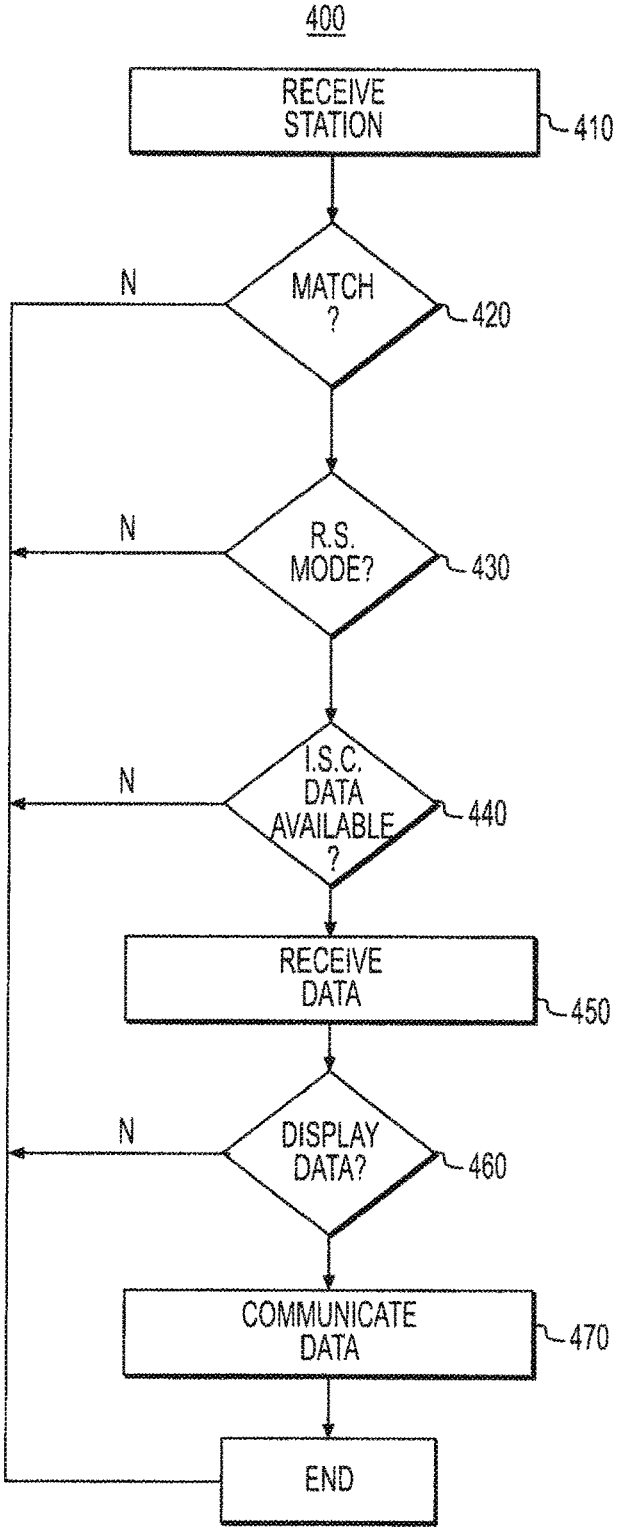
FIG. 4 illustrates an example of a method for seamlessly integrating additional content with a radio broadcast.

FIG. 4 illustrates an example of a method 400 for seamlessly integrating additional content with a radio broadcast. The method 400 may be implemented on a processer, such as computer 100.

In operation 410, a station is received. The station being received may occur via numerous techniques and methods. For example, a user or operator associated with a user interface may manually enter a frequency associated with a terrestrially broadcast radio station. In other example, the user may scroll or tune into the station. The station may be automatically selected using seek or automatic detection technique.

The examples above involve instances in which a user selects a terrestrially provided radio station. In other cases, the user may select an Internet streaming channel through any of the aforementioned techniques discussed above.

In operation 420, a determination is made as to whether the received station above has a correspondence between a terrestrial broadcast station and an Internet streaming channel. If yes, the method 400 proceeds to operation 430. If no, the method 400 proceeds to the end.

Various techniques may be employed to determine whether the terrestrial radio station and the Internet streaming station match. In one example, data provided from both (i.e. through a bit stream or through a protocol that allows information to be sent via an analog radio wave) may be received and analyzed to determine if there is a match. Alternatively, audio from both sources may be recorded, and transmitted to a digital signal processing (DSP) device to analyze whether the two stations match each other. In another example, the user may manually enter a match between two sources, such as a terrestrially provided radio station and an Internet streaming channel. Further, the actual information received from the terrestrial station or the Internet streaming channel may contain information, such as a URL linking the station to another station.

In addition to all of the linking/matching techniques discussed above, the method 400 may be provided with an additional operation of storing the information for later usage and recall.

In operation 430, a determination is made as to whether the device associated with the selected radio station is actively listening to, or providing content from the terrestrial broadcast station. If no, the method 400 proceeds to end. If yes, the method 400 proceeds to operation 440.

In operation 440, a determination is made as to whether there is additional data (i.e. non-audio data, such as those enumerated above with regards to data packet 292) associated with the Internet streaming channel that matches the terrestrial broadcast station. If no, the method 400 proceeds to end. If yes, the method 400 proceeds to operation 450.

In operation 450, a request is made to the Internet streaming channel for non-audio content, such as those enumerated above with regards to data packet 292. If the data exists, the non-audio content is received.

In operation 460, a determination is made as to whether to display the data received in operation 450. If no, the method 400 proceeds to end. If yes, the method 400 proceeds to operation 470, where the data is displayed.

In an alternate implementation of method 400, the data received in operation 450 may be displayed at a later time based on a specifically defined context or signal. For example, the data may be configured to be displayed when a vehicle is in a 'park mode' if the radio device accessing the station is installed in a vehicle. Thus, the user associated with method 400 may access the data at a later date or time.

Figure 5:
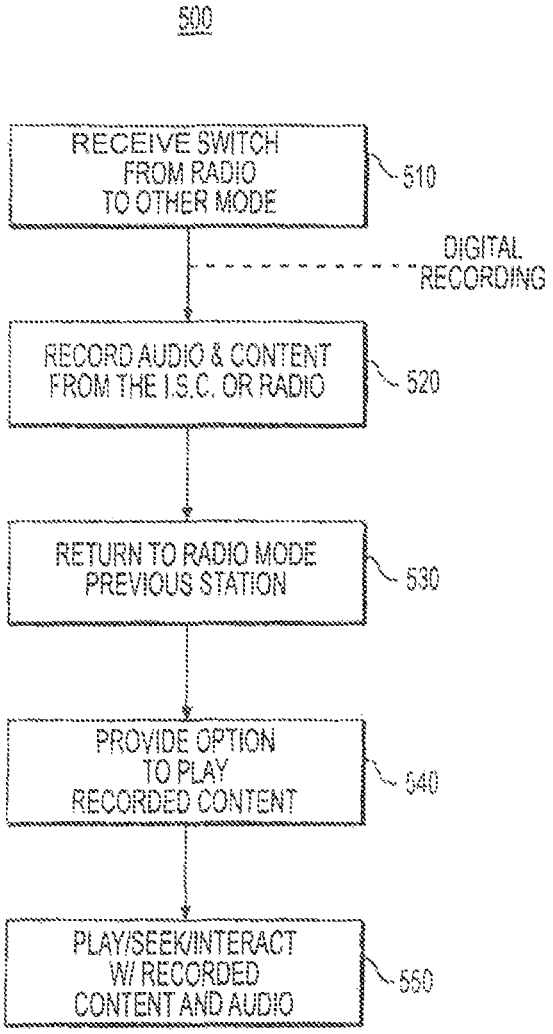
FIG. 5 illustrates an example of a method for storing content associated with a radio-based program.

FIG. 5 illustrates an example of a method 500 for storing content associated with a radio based program. The method 500 may be combined selectively with any of the elements or operations discussed with regards to method 400. The method 500 may be implemented on a device, such as computer 100.

In operation 510, a signal or digital indication is received that a switch from a consumption or listening of a radio station (terrestrially provided) matched to an Internet streaming channel, is made. As explained above, certain stations may be provided through different mediums, such as a radio tower or Internet streaming channel.

At this juncture, if a recordation command is to occur (i.e. a digital recording of the audio), this process may commence. A recordation command refers to recording audio associated with a radio broadcast that may be recalled at a further time.

In operation 520, the audio content from the switch from station is recorded. In this operation, the augmented information associated with the Internet streaming channel is also recorded. The augmented information may refer to the information defined in the explanation of data packet 292.

In operation 530, a detection is made as to whether a user has returned to access the station switched from in operation 510. After which, the user may be presented with an option to access the content with the additional/augmented content also recorded in operation 520 (operation 540).

In operation 550, the recorded content is provided with standard playback options (play/seek/interact/rewind/forward, etc). If the user has requested to also be provided with the augmented content (in operation 540), the user is also provided this information as well. As explained above, with regards to FIG. 2, the augmented content may be audio content and/or non-audio content (i.e. visual, metadata, text, or the like).

A computer program (also known as a program, module, engine, software, software application, script, or code) can be written in any form of programming language, including compiled or interpreted languages, declarative or procedural languages, and the program can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

To provide for interaction with an individual, the herein disclosed embodiments can be implemented using an interactive display, such as a graphical user interface (GUI). Such GUI's may include interactive features such as pop-up or pull-down menus or lists, selection tabs, scannable features, and other features that can receive human inputs.

The computing system disclosed herein can include clients and servers. A client and server are generally remote from each other and typically interact through a communications network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

We claim:

1. A system for integrating audio content presented in a vehicle via an audio playback device of the vehicle with additional digital content, comprising:

a data store comprising a non-transitory computer readable medium storing a program of instructions for the integration of the audio content;

a processor that executes the program of instructions;

a mode receiver configured to receive a mode notification that indicates whether the audio playback device is in a radio reception mode or an Internet streaming reception mode, wherein the mode receiver temporarily stores the mode notification in a register associated with the data store;

a content retriever configured to:

determine the mode of the audio playback device based on the mode notification stored in the register;

in response to determining that the audio playback device is in the radio reception mode, retrieve the audio content from a terrestrial radio station and determine whether the additional digital content is available for the audio content; and retrieve the additional digital content from an Internet streaming channel, the terrestrial radio station and the Internet streaming channel being associated with an audio program; and a display driver configured to communicate the additional digital content to a human-machine interface (HMI) display of the vehicle along with the presentation of the audio content, wherein:

the retrieved audio content includes information associated with matching the terrestrial broadcast station with the Internet streaming channel;

the additional digital content is non-audio content and served simultaneously from the Internet streaming channel with digital audio content corresponding to the audio content from the terrestrial radio station;

the display driver is configured to delay the delivery of the additional digital content until a predefined event has occurred; and the predefined event is a signal associated with a non-driving state.

2. The system according to claim 1, wherein the radio reception mode indicates that the audio playback device is receiving station information from the terrestrial broadcast station, and wherein the Internet steaming mode indicates that the audio playback device is receiving audio information from the Internet streaming channel.

3. The system according to claim 1, further comprising a display selector configured to allow a user to decide whether the additional digital content is displayed.

4. The system according to claim 1, wherein the additional digital content is defined by a graphical user interface that in response to being accessed, delivers content from a third-party source.

5. The system according to claim 1, wherein the non-driving state includes parking.

6. The system according to claim 1, wherein the additional digital content includes time data, the time data indicating a specific point at the audio content to be displayed.

7. A system for integrating audio content presented in a vehicle via an audio playback device of the vehicle with additional digital content, comprising:

a data store comprising a non-transitory computer readable medium storing a program of instructions for the integration of the audio content;

a processor that executes the program of instructions;

a mode receiver configured to receive a mode notification that indicates whether the audio playback device is in a radio reception mode or an Internet streaming reception mode, wherein the mode receiver temporarily stores the mode notification in a register associated with the data store;

a content retriever configured to:

determine the mode of the audio playback device based on the mode notification stored in the register;

in response to determining that the audio playback device is in the radio reception mode, retrieve the audio content from a terrestrial radio station and determine whether the additional digital content is available for the audio content; and retrieve the additional digital content from an Internet streaming channel, the terrestrial radio station and the Internet streaming channel being registered as providing a matching audio program; and an augmented content driver configured to communicate the additional digital content to an output device of the vehicle, wherein:

the retrieved audio content includes information associated with matching the terrestrial broadcast station with the Internet streaming channel;

the additional digital content is non-audio content and served simultaneously from the Internet streaming channel with digital audio content corresponding to the audio content from the terrestrial radio station;

the augmented content driver is configured to delay the delivery of the additional digital content until a predefined event has occurred; and the predefined event is a signal associated with a non-driving state.

8. The system according to claim 7, wherein the radio reception mode indicates that the audio playback device is receiving station information from the terrestrial broadcast station, and wherein the Internet steaming mode indicates that the audio playback device is receiving audio information from the Internet streaming channel.

9. The system according to claim 7, further comprising a display selector configured to allow a user to decide whether the additional digital content is outputted.

10. The system according to claim 7, wherein the additional digital content is defined by a graphical user interface that in response to being accessed, delivers content from a third-party source.

11. The system according to claim 7, wherein the the non-driving state includes parking.

12. The system according to claim 7, wherein the additional digital content includes time data, the time data indicating a specific point at the audio content to be displayed.

13. The system according to claim 2, wherein the mode switches to the reception of the terrestrial radio station and a presentation of the additional digital content in response to the Internet streaming channel being unavailable.

14. A system for integrating audio content presented in a vehicle via an audio playback device of the vehicle with additional digital content, comprising:

at least one memory including a program of instructions for the integration of the audio content;

at least one processor configured to execute the program of instructions, wherein the at least one memory and the program of instructions are configured to, with the at least one processor, cause the system at least to:

receive a mode notification that indicates whether the audio playback device is in a radio reception mode or an Internet streaming reception mode;

store the mode notification in a register associated with the data store;

determine the mode of the audio playback device based on the mode notification stored in the register;

in response to determining that the audio playback device is in the radio reception mode, retrieve the audio content from a terrestrial radio station;

retrieve the additional digital content from an Internet streaming channel, wherein the terrestrial radio station and the Internet streaming channel are streaming the audio content and wherein the additional digital content is non-audio content served from the Internet streaming channel with a digital audio content version of the audio content, wherein the audio content is an audio program;

match the additional digital content to the audio content of the terrestrial radio station; and communicate the additional digital content to a human-machine interface (HMI) display of the vehicle along with the presentation of the audio content based on the matching of the additional digital content to the audio content of the terrestrial radio station;

delay the delivery of the additional digital content until a predefined event has occurred; and the predefined event is a signal associated with a non-driving state.

15. The system according to claim 14, wherein the at least one memory and the program of constructions are further configured to, with the at least one processor, cause the system at least to allow a user to decide whether the additional digital content is displayed.

16. The system according to claim 14, wherein the at least one memory and the program of constructions are configured to, with the at least one processor, cause the system at least to match the additional digital content to the audio content of the terrestrial radio station by analyzing data received with the terrestrial radio station.

17. The system according to claim 14, wherein the at least one memory and the program of constructions are configured to, with the at least one processor, cause the system at least to match the additional digital content to the audio content of the terrestrial radio station by comparing the audio content of the terrestrial radio station with the digital content.

* * * * *